US009475306B2

(12) United States Patent
Andou et al.

(10) Patent No.: US 9,475,306 B2
(45) Date of Patent: Oct. 25, 2016

(54) THERMAL HEAD, AND THERMAL PRINTER

(71) Applicant: KYOCERA Corporation, Kyoto-shi, Kyoto (JP)

(72) Inventors: Tsuyoshi Andou, Kirishima (JP); Hiroshi Masutani, Yokohama (JP); Kouji Ochi, Kirishima (JP); Youichi Moto, Okaya (JP); Yousuke Iwamoto, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 14/785,131

(22) PCT Filed: Apr. 17, 2014

(86) PCT No.: PCT/JP2014/060985
§ 371 (c)(1),
(2) Date: Oct. 16, 2015

(87) PCT Pub. No.: WO2014/171524
PCT Pub. Date: Oct. 23, 2014

(65) Prior Publication Data

US 2016/0059580 A1 Mar. 3, 2016

(30) Foreign Application Priority Data

Apr. 17, 2013 (JP) ..... 2013-086711

(51) Int. Cl.
*B41J 29/393* (2006.01)
*B41J 2/335* (2006.01)

(52) U.S. Cl.
CPC ..... *B41J 2/3353* (2013.01); *B41J 2/3351* (2013.01); *B41J 2/3354* (2013.01); *B41J 2/3355* (2013.01); *B41J 2/3357* (2013.01)

(58) Field of Classification Search
CPC ..... B41J 2002/14419; B41J 2/14274; B41J 2/14; B41J 2/145; B41J 2/14145; B41J 2/1433; B41J 2/1621; B41J 2/164; B41J 2/1606; B41J 2202/03; B41J 2/14072; B41J 2202/15; B41J 2/14088
See application file for complete search history.

(56) References Cited

FOREIGN PATENT DOCUMENTS

| | | |
|---|---|---|
| JP | 2002-307733 A | 10/2002 |
| JP | 2010-173128 A | 8/2010 |

OTHER PUBLICATIONS

International Search Report mailed on Jul. 8, 2014 and issued for International Patent Application No. PCT/JP2014/060985.

*Primary Examiner* — Lamson Nguyen
(74) *Attorney, Agent, or Firm* — Volpe and Koenig, P.C.

(57) ABSTRACT

To provide a thermal head in which separation of a protective layer is unlikely to occur. A thermal head X1 includes a substrate 7, a heat-generating portion 9 disposed on the substrate 7, electrodes 17 and 19 disposed on the substrate 7 and electrically connected to the heat-generating portion 9, and a protective layer 25 which covers the heat-generating portion 9 and part of the electrodes 17 and 19. The electrodes 17 and 19 each includes a first region R1 which lies below a depth of 150 nm from the surface 17*e* or 19*e* located on the protective layer 25 side, and the first region R1 contains oxygen. It is possible to suppress separation of each of the electrodes 17 and 19 from the protective layer 25.

20 Claims, 7 Drawing Sheets

THERMAL HEAD, AND THERMAL PRINTER

TECHNICAL FIELD

The present invention relates to a thermal head and a thermal printer.

BACKGROUND

Various thermal heads have been proposed as printing devices, such as facsimile machines and video printers. A thermal head includes, for example, a substrate, a heat-generating portion disposed on the substrate, an electrode disposed on the substrate and electrically connected to the heat-generating portion, and a protective layer which covers the heat-generating portion and part of the electrode (for example, refer to PTL 1).

PRIOR ART DOCUMENT

Patent Document

PTL 1: Japanese Unexamined Patent Application Publication No. 2002-307733

SUMMARY OF THE INVENTION

Problem to be Solved by the Invention

However, in the thermal head described in PTL 1, the coefficient of thermal expansion of the electrode is higher than the coefficient of thermal expansion of the protective layer, and there is a possibility that voids will occur between the electrode and the protective layer. Consequently, there is a possibility that adhesion between the electrode and the protective layer will decrease.

Solution to Problem

A thermal head according to an embodiment of the present invention includes a substrate, a heat-generating portion disposed on the substrate, an electrode disposed on the substrate and electrically connected to the heat-generating portion, and a protective layer which covers the heat-generating portion and part of the electrode. Furthermore, the electrode includes a first region which lies below a depth of 150 nm from a surface located on the protective layer side, and the first region contains oxygen.

A thermal printer according to another embodiment of the present invention includes the thermal head described above, a conveying mechanism that conveys a recording medium onto the heat-generating portion, and a platen roller that presses the recording medium against the heat-generating portion.

Advantageous Effects of Invention

According to the present invention, the coefficient of thermal expansion of the electrode can be brought close to the coefficient of thermal expansion of the protective layer, and it is possible to reduce the possibility that voids will occur between the protective layer and the electrode. Consequently, it is possible to reduce the possibility that adhesion between the electrode and the protective layer will decrease.

EMBODIMENTS FOR CARRYING OUT THE INVENTION

First Embodiment

Figure 1:
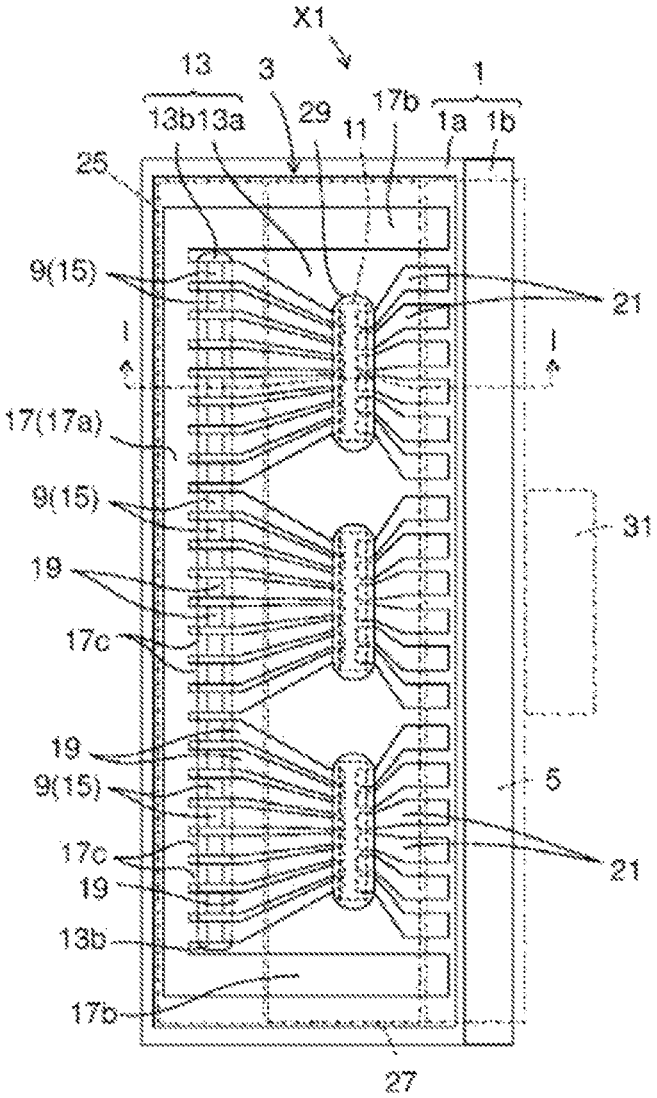
FIG. 1 is a plan view of a thermal head according to a first embodiment of the present invention.

A thermal head X1 will be described below with reference to FIGS. 1 to 3. The thermal head X1 includes a heat sink 1, a head base body 3 placed on the heat sink 1, and a flexible printed wiring board 5 (hereinafter, referred to as the "FPC 5") connected to the head base body 3. Note that, in FIG. 1, the FPC 5 is not shown, but a region in which the FPC 5 is placed is indicated by the dash-dot line.

The heat sink 1 is formed like a plate and has a rectangular shape in plan view. The heat sink 1 includes a plate-like support 1*a* and a protrusion 1*b* protruding from the support 1*a*. The heat sink 1 is, for example, made of a metal material, such as copper, iron, or aluminum, and has a function of dissipating part of heat that is generated by heat-generating portions 9 of the head base body 3 and that does not contribute to printing. Furthermore, the head base body 3 is bonded to the upper surface of the support 1*a* with a double-sided tape, an adhesive, or the like (not shown).

The head base body 3 is formed like a plate, in plan view, and includes components constituting the thermal head X1 on a substrate 7. The head base body 3 has a function of performing printing on a recording medium (not shown) in response to electrical signals supplied from the outside.

The FPC 5 is electrically connected to the head base body 3 and includes an insulating resin layer and a plurality of printed wires patterned in the insulating resin layer. The FPC 5 is a wiring board having a function of supplying electric current and electrical signals to the head base body 3. One end portion of each printed wire is exposed from the resin layer and the other end portion thereof is electrically connected to a connector 31.

The printed wires of the FPC 5 are connected to connection electrodes 21 of the head base body 3 by a conductive bonding material 23. Thereby, the head base body 3 and the FPC 5 are electrically connected to each other. Examples of the conductive bonding material 23 include a solder material and an anisotropic conductive material obtained by mixing conductive particles in a resin having an electrical insulation property.

A reinforcing plate (not shown) made of a resin, such as a phenolic resin, a polyimide resin, or a glass epoxy resin, may be provided between the FPC 5 and the heat sink 1. Furthermore, the reinforcing plate may be connected to the entire area of the FPC 5. By bonding the reinforcing plate to the lower surface of the FPC 5 with a double-sided tape, an adhesive, or the like, the FPC 5 can be reinforced.

Although the example in which the FPC 5 is used as a wiring board has been described, a hard wiring board may be used instead of the FPC 5 which has flexibility. Examples of the hard printed wiring board include substrates made of a resin, such as a glass epoxy substrate and a polyimide substrate.

Furthermore, without using a wiring board, connector pins (not shown) of the connector 31 may be directly connected to the connection electrodes 21 of the head base body 3. In this case, the connector pins and the connection electrodes 21 may be connected to each other by a solder or a conductive bonding material.

The components constituting the head base body 3 will be described below.

The substrate 7 is made of an electrically insulating material such as alumina ceramic, a semiconductor material such as single-crystal silicon, or the like.

A heat storage layer 13 is disposed on the upper surface of the substrate 7. The heat storage layer 13 includes a base 13*a* and an elevated portion 13*b*. The base 13*a* is formed so as to extend over the entire area of the upper surface of the substrate 7. The elevated portion 13*b* extends like a band along the direction in which a plurality of heat-generating portions 9 are arranged, and has a substantially semi-elliptical cross section. The elevated portion 13*b* functions so as to appropriately press a recording medium to be printed against a protective layer 25 formed on the heat-generating portions 9.

The heat storage layer 13 is made of glass having low thermal conductivity and is capable of temporarily storing part of heat generated by the heat-generating portions 9. Therefore, the heat storage layer 13 can shorten the time required to raise the temperature of the heat-generating portions 9, and functions so as to enhance the heat response characteristics of the thermal head X1. The heat storage layer 13 is formed, for example, by applying a predetermined glass paste obtained by mixing glass powder with an appropriate organic solvent to the upper surface of the substrate 7 by screen printing or the like, followed by firing.

An electrical resistance layer 15 is disposed on the upper surface of the heat storage layer 13, and a common electrode 17, individual electrodes 19, and the connection electrodes 21 are disposed on the electrical resistance layer 15. The electrical resistance layer 15 is patterned in the same shape as that of the common electrode 17, the individual electrodes 19 and the connection electrodes 21, and has exposed regions in which the electrical resistance layer 15 is exposed between the common electrode 17 and the individual electrodes 19.

As shown in FIG. 1, the exposed regions of the electrical resistance layer 15 are placed in a row on the elevated portion 13*b* of the heat storage layer 13, and the exposed regions each constitute a heat-generating portion 9. A plurality of heat-generating portions 9 are shown in a simplified manner in FIG. 1 for convenience of explanation, but are disposed, for example, at a density of 100 to 2,400 dpi (dot per inch). The electrical resistance layer 15 has a thickness of about 20 to 100 nm, and is made of, for example, a material having relatively high electrical resistance, such as a TaN-based, TaSiO-based, TaSiNO-based, TiSiO-based, TiSiCO-based, CrSiO-based, or NbSiO-based material. Therefore, when a voltage is applied to the heat-generating portions 9, the heat-generating portions 9 generate heat by Joule heating.

Figure 2:
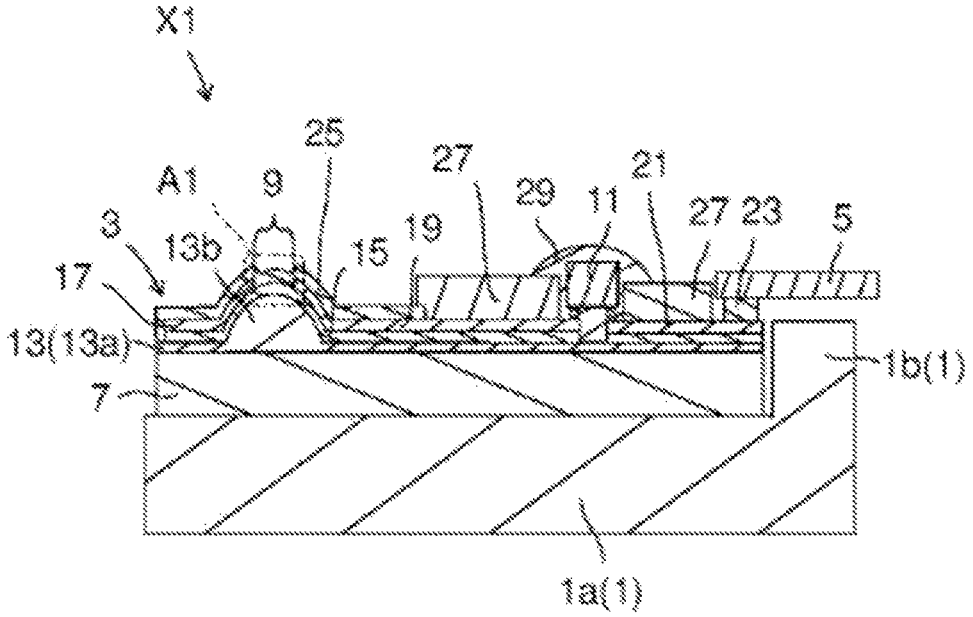
FIG. 2 is a cross-sectional view taken along the line I-I of FIG. 1.
Figure 3:
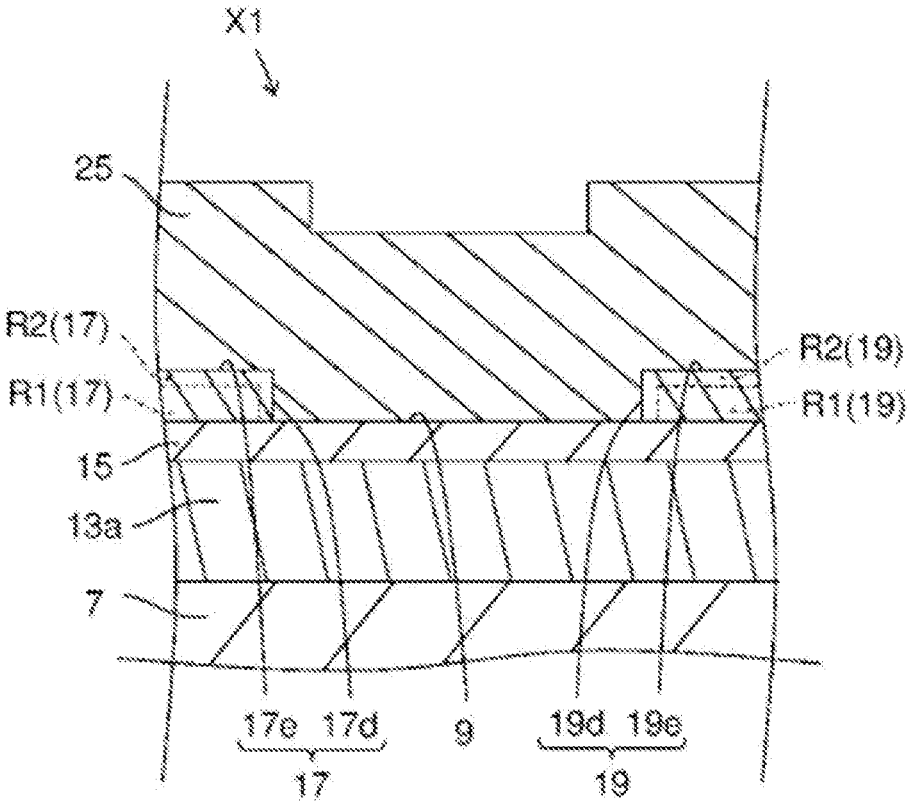
FIG. 3 is an enlarged cross-sectional view of a region A1 shown in FIG. 2.

As shown in FIGS. 1 and 2, the common electrode 17, a plurality of individual electrodes 19, and a plurality of connection electrodes 21 are disposed on the upper surface of the electrical resistance layer 15. The common electrode 17, the individual electrodes 19, and the connection electrodes 21 have a thickness of about 0.05 to 2.00 μm and are made of an aluminum material containing oxygen.

The common electrode 17 includes a main wiring portion 17*a*, sub-wiring portions 17*b*, and lead portions 17*c*. The main wiring portion 17*a* extends along one long side of the substrate 7. The sub-wiring portions 17*b* extend along one and the other short sides of the substrate 7. The lead portions 17*c* individually extend from the main wiring portion 17*a* toward the heat-generating portions 9. One end portion of the common electrode 17 is connected to the plurality of heat-generating portions 9, and the other end portion thereof is connected to the FPC 5. Thus, the common electrode 17 electrically connects the FPC 5 to the heat-generating portions 9.

One end portion of each of the individual electrodes 19 is connected to a corresponding one of the heat-generating portions 9, and the other end portion thereof is connected to a driver IC 11. Thus, each of the heat-generating portions 9 is electrically connected to the driver IC 11. Furthermore, the individual electrodes 19 divide the plurality of heat-generating portions 9 into a plurality of groups and electrically connect the heat-generating portions 9 in each group to the driver IC 11 provided so as to correspond to the group.

One end portion of each of the connection electrodes 21 is connected to a driver IC 11, and the other end portion thereof is connected to the FPC 5. Thus, the driver IC 11 is electrically connected to the FPC 5. The plurality of connection electrodes 21 connected to one driver IC 11 are formed of a plurality of wires having different functions.

As shown in FIG. 1, a driver IC 11 is placed so as to correspond to one group of a plurality of heat-generating portions 9, and is connected to the other end portion of each of the individual electrodes 19 and the one end portion of each of the connection electrodes 21. The driver IC 11 has a function of controlling the current-carrying state of each of the heat-generating portions 9. As the driver IC 11, a switching member including a plurality of switching elements may be used.

The electrical resistance layer 15, the common electrode 17, the individual electrodes 19, and the connection electrodes 21 are formed, for example, by stacking material layers for forming these components successively on the heat storage layer 13 by a known thin-film forming technique such as sputtering, and then processing the stacked body into a predetermined pattern using a known photo etching process or the like. Note that the common electrode 17, the individual electrodes 19, and the connection electrodes 21 can be formed simultaneously by the same process.

As shown in FIGS. 1 and 2, a protective layer 25 which covers the heat-generating portions 9, part of the common electrode 17, and part of the individual electrodes 19 is formed on the heat storage layer 13 disposed on the upper surface of the substrate 7. In FIG. 1, for convenience of explanation, the protective layer 25 is not shown, but a region in which the protective layer 25 is to be formed is indicated by the dash-dot line.

The protective layer 25 protects the covered areas of the heat-generating portions 9, the common electrode 17, and the individual electrodes 19 from corrosion due to adhesion of moisture or the like included in the atmosphere or from abrasion due to contact with a recording medium on which printing is to be performed. The protective layer 25 can be made of SiN, SiO, SiON, SiC, SiCN, diamond-like carbon, or the like. The protective layer 25 may have a single-layer structure or a multilayer structure obtained by stacking layers of these materials. The protective layer 25 can be formed using sputtering, screen printing, or the like.

Furthermore, as shown in FIGS. 1 and 2, a covering layer 27 which partially covers the common electrode 17, the individual electrodes 19, and the connection electrodes 21 is disposed on the base 13*a* of the heat storage layer 13 formed on the upper surface of the substrate 7. In FIG. 1, for convenience of explanation, a region in which the covering layer 27 is to be formed is indicated by the dash-dot line.

The covering layer 27 protects the covered areas of the common electrode 17, the individual electrodes 19, and the connection electrodes 21 from oxidation due to contact with the atmosphere or from corrosion due to adhesion of moisture or the like included in the atmosphere. In order to more reliably protect the common electrode 17 and the individual electrodes 19, preferably, the covering layer 27 is formed so as to overlie the end portion of the protective layer 25 as shown in FIG. 2. The covering layer 27 can be formed using a resin material, such as an epoxy resin or a polyimide resin, by a thick-film forming technique such as screen printing.

Openings (not shown) for exposing the individual electrodes 19 and the connection electrodes 21 to be connected to the driver ICs 11 are formed in the covering layer 27, and these wires are connected to the driver ICs 11 through the openings. Furthermore, the driver ICs 11 are sealed by being covered by a covering member 29 made of a resin, such as an epoxy resin or a silicone resin, in order to protect the driver ICs 11 and connecting portions between the driver ICs 11 and these wires, in a state of being connected to the individual electrodes 19 and the connection electrodes 21.

The common electrode 17 and the individual electrode 19 will be described in detail with reference to FIG. 3. As described above, the common electrode 17 and the individual electrode 19 are integrally formed by a thin-film forming technique, and the electrode of the present invention will be described using the common electrode 17 and the individual electrode 19.

The common electrode 17 and the individual electrode 19 are each made of aluminum containing oxygen. Furthermore, the common electrode 17 and the individual electrode 19 each include a first region R1 and a second region R2. The first region R1 lies below a depth of 150 nm from a surface located on the protective layer 25 side. The second region R2 extends to a distance of 150 nm from the surface located on the protective layer 25 side. The surface located on the protective layer 25 side of the common electrode 17 is an upper surface 17*e*, and the surface located on the protective layer 25 side of the individual electrode 19 is an upper surface 19*e*.

The first region R1 is disposed on the electrical resistance layer 15 and located closer to the electrical resistance layer 15 side than to the protective layer 25 in each of the common electrode 17 and the individual electrode 19. The second region R2 is disposed on the first region R1 and constitutes a surface layer region in each of the common electrode 17 and the individual electrode 19.

The first region R1 contains oxygen, and, for example, preferably contains 1 to 13 atomic percent of oxygen. Furthermore, preferably, the concentration gradient of oxygen is 1 atomic percent/nm or less toward the protective layer 25. Furthermore, preferably, the absolute value of the difference between the oxygen content in the first region R1 and the average oxygen content in the first region R1 is 1 atomic percent or less. That is, in the first region R1, preferably, the oxygen content is a constant.

The second region R2 contains oxygen, and, for example, preferably contains 1 to 50 atomic percent of oxygen. Furthermore, preferably, the concentration gradient of oxygen is 4 to 13 atomic percent/nm toward the protective layer 25. Furthermore, preferably, the concentration gradient of oxygen in the second region R2 increases toward the protective layer 25.

The second region R2 is a region extending to a distance of 150 nm from the surfaces 17*d* and 17*e* located on the protective layer 25 side in each of the common electrode 17 and the individual electrode 19.

The common electrode 17 and the individual electrodes 19 of the thermal head X1 can be formed, for example, by the method described below.

First, a material layer for forming the common electrode 17 and the individual electrodes 19 is formed by sputtering over the entire area of the electrical resistance layer 15. At this time, the material layer is formed in a state in which oxygen gas is mixed such that the partial pressure is 2% relative to argon gas. Then, a pattern is formed using a photolithographic technique.

Subsequently, by performing heat treatment on the common electrode 17 and the individual electrodes 19 in an oxygen atmosphere, first regions R1 and second regions R2 are formed. In the heat treatment, the common electrode 17 and the individual electrodes 19 may be heated in air at 200° C. for 120 minutes.

The oxygen content in each of the common electrode 17 and the individual electrodes 19 can be measured by X-ray photoelectron spectroscopy (XPS). For example, using XPS in the depth direction from the surfaces 17*d* and 17*e* located on the protective layer 25 side in the common electrode 17 or the individual electrode 19, the oxygen contents at a plurality of different points in the depth direction may be measured. Furthermore, in order to determine the average oxygen content, a method may be used in which the oxygen contents at three different points in the depth direction are measured, and their average is calculated. Furthermore, in order to determine the concentration gradient of oxygen, a method may be used in which the oxygen contents at a plurality of points in the depth direction are measured, an approximation is obtained from the oxygen contents using the least squares method, and the slope of the approximation is defined as the concentration gradient of oxygen. Specifically, the oxygen contents at three different points in the depth direction are measured, an approximation is obtained from the three points, and the concentration gradient is measured.

The coefficient of thermal expansion of aluminum is about $23\times10^{-6}$/K, and as the amount of oxygen contained in aluminum increases, the coefficient of thermal expansion of the common electrode 17 and the individual electrode 19 decreases. Furthermore, the coefficient of thermal expansion of the protective layer 25 disposed on the common electrode 17 and the individual electrode 19 is about $0.6\times10^{-6}$/K when the protective layer 25 is made of $SiO_2$, about $3.2\times10^{-6}$/K when made of $Si_3N_4$, and about $4.6\times10^{-6}$/K when made of SiON. The protective layer 25 has a lower coefficient of thermal expansion than the common electrode 17 and the individual electrode 19.

Each of the common electrode 17 and the individual electrode 19 contains oxygen in the first region R1 which lies below a depth of 150 nm from the surfaces 17*d* and 17*e* located on the protective layer 25 side. In other words, each of the common electrode 17 and the individual electrode 19 contains oxygen even in the interior portion.

Therefore, the coefficient of thermal expansion of each of the common electrode 17 and the individual electrode 19 can be brought close to the coefficient of thermal expansion of the protective layer 25. Accordingly, by relaxing stress generated between each of the common electrode 17 and the individual electrode 19 and the protective layer 25, it is possible to reduce the possibility that voids will occur between each of the common electrode 17 and the individual electrode 19 and the protective layer 25. Consequently, it is possible to reduce the possibility that adhesion between each of the common electrode 17 and the individual electrode 19 and the protective layer 25 will decrease.

That is, since each of the common electrode 17 and the individual electrode 19 contains oxygen even in the interior portion, the coefficient of thermal expansion of each of the common electrode 17 and the individual electrode 19 can be brought close to the coefficient of thermal expansion of the protective layer 25.

Furthermore, the first region R1 contains oxygen in an amount of 1 to 13 atomic percent. Therefore, while bringing the coefficient of thermal expansion of each of the common electrode 17 and the individual electrode 19 close to the coefficient of thermal expansion of the protective layer 25, it is possible to suppress an increase in the resistivity of each of the common electrode 17 and the individual electrode 19, and the function as an electrode can be maintained.

Furthermore, in the first region R1, the concentration gradient of oxygen is preferably 1 atomic percent/nm or less toward the protective layer 25, and the composition of the interior portion of each of the common electrode 17 and the individual electrode 19 is preferably in a uniform state. Thereby, a stable function as an electrode can be achieved. Furthermore, since the composition of the interior portion of each of the common electrode 17 and the individual electrode 19 is in a uniform state, the coefficient of thermal expansion of the interior portion of each of the common electrode 17 and the individual electrode 19 can be brought close to a uniform value, and it is possible to suppress generation of stress in the interior portion of each of the common electrode 17 and the individual electrode 19.

Furthermore, since the absolute value of the difference between the oxygen content in the first region R1 and the average oxygen content in the first region R1 is 1 atomic percent or less, the composition of the interior portion of each of the common electrode 17 and the individual electrode 19 is in a uniform state, and a stable function as an electrode can be achieved. Furthermore, the coefficient of thermal expansion of the interior portion can be brought to a uniform value, and it is possible to suppress generation of stress in the interior portion of each of the common electrode 17 and the individual electrode 19. More preferably, the absolute value of the difference between the oxygen content and the average oxygen content in the first region R1 is 0.5 atomic percent or less.

In the thermal head X1, each of the common electrode 17 and the individual electrode 19 includes a second region R2 which extends to a distance of 150 nm from the surfaces 17*d* and 17*e* located on the protective layer 25 side, and the second region R2 contains oxygen. Therefore, it is possible to decrease the coefficient of thermal expansion of the second region R2 located on the protective layer 25 side, and it is possible to reduce the possibility that voids will occur between the second region R2 and the protective layer 25. Consequently, it is possible to further reduce the possibility of separation of each of the common electrode 17 and the individual electrode 19 from the protective layer.

Furthermore, the second region R2 contains 1 to 50 atomic percent of oxygen. Therefore, it is possible to reduce the amount of stress generated by the coefficient of thermal expansion of each of the common electrode 17 and the individual electrode 19 and the coefficient of thermal expansion of the protective layer 25, and it is possible to reduce the possibility of separation of each of the common electrode 17 and the individual electrode 19 from the protective layer 25.

Furthermore, since the oxygen content in the second region R2 increases, corrosion resistance can be improved. Furthermore, since the oxygen content in the second region R2 increases, it is possible to reduce heat dissipation from each of the common electrode 17 and the individual electrode 19, and thermal efficiency can be improved.

Furthermore, in the second region R2, preferably, the concentration gradient of oxygen is 4 to 13 atomic percent/nm toward the protective layer 25. Thereby, while reducing the possibility that voids will occur between each of the common electrode 17 and the individual electrode 19 and the protective layer 25, it is possible to suppress an increase in the resistivity of each of the common electrode 17 and the individual electrode 19.

That is, since the concentration gradient of oxygen in the second region R2 is 4 atomic percent/nm or more toward the protective layer 25, the coefficient of thermal expansion of the second region R2 gradually decreases toward the protective layer 25, the second region R2 functions as a buffer against the difference in the coefficient of thermal expansion between the first region R1 and the protective layer 25.

Furthermore, since the concentration gradient of oxygen in the second region R2 is 13 atomic percent/nm or less toward the protective layer 25, it is possible to reduce the possibility that a large amount of stress will be applied to the inside of the second region R2, and it is possible to reduce the possibility that the protective layer 25 will be separated from the second region R2.

Furthermore, preferably, the concentration gradient of oxygen in the second region R2 increases toward the protective layer 25. Thereby, since the oxygen content in the second region R2 increases toward the protective layer 25, it is possible to bring the coefficient of thermal expansion of each of the common electrode 17 and the individual electrode 19 closer to the coefficient of thermal expansion of the protective layer 25.

Furthermore, since the oxygen content in the second region R2 is higher than the oxygen content in the first region R1, it is possible to reduce the possibility that the electrical resistance layer 15 will be oxidized. That is, since the oxygen content in the first region R1 is lower than the oxygen content in the second region R2, it is possible to reduce the possibility that the electrical resistance value of the heat-generating portion 9 formed by a portion of the electrical resistance layer 15 will change with time.

Furthermore, in the configuration described above, the second region R2 having a low coefficient of thermal expansion is placed on the protective layer 25. Consequently, it is possible to decrease the coefficient of thermal expansion of each of the common electrode 17 and the individual electrode 19 toward the protective layer 25 side, and it is possible to reduce the possibility of separation of each of the common electrode 17 and the individual electrode 19 from the protective layer 25.

As described above, in the thermal head X1, each of the common electrode 17 and the individual electrode 19 contains oxygen in the first region R1 which lies below a depth of 150 nm from the surfaces 17*d* and 17*e* located on the protective layer 25 side and also contains oxygen in the second region R2. Consequently, while maintaining the function as an electrode, it is possible to bring the coefficient of thermal expansion of each of the common electrode 17 and the individual electrode 19 close to the coefficient of thermal expansion of the protective layer 25, and it is possible to reduce the possibility of separation of each of the common electrode 17 and the individual electrode 19 from the protective layer 25.

Furthermore, the maximum height (Ry) of each of the common electrode 17 and the individual electrode 19 is preferably 0.095 to 0.2 μm. When the maximum height (Ry) of each of the common electrode 17 and the individual electrode 19 is 0.095 to 0.2 μm, it is possible to further improve adhesion between each of the common electrode 17 and the individual electrode 19 and the protective layer 25.

Furthermore, the maximum height (Ry) of each of the common electrode 17 and the individual electrode 19 may be 0.005 to 0.095 μm. In this case, the surface of each of the common electrode 17 and the individual electrode 19 is smooth, and it is possible to secure the sealing property of the protective layer 25.

In order to determine the maximum height (Ry) of each of the common electrode 17 and the individual electrode 19, the thermal head X1 is cut perpendicular to the upper surfaces 17*e* and 19*e* of the common electrode 17 and the individual electrode 19, respectively, to obtain cut surfaces and by subjecting the cut surfaces to image processing, roughness curves corresponding to the upper surfaces 17*e* and 19*e* of the common electrode 17 and the individual electrode 19 are obtained. A section of standard length is sampled from a parallel line of the roughness curve, the distance between the peaks and valleys of the sampled section is measured, and thus the maximum height (Ry) can be obtained. Note that when the section of standard length is sampled, the part where peaks and valleys are wide enough to be interpreted as scratches should be avoided.

Furthermore, the first regions R1 and the second regions R2 are defined, for example, by the distances from the surfaces 17*e* and 19*e* of the common electrode 17 and the individual electrode 19. The regions extending from the surfaces 17*e* and 19*e* of the common electrode 17 and the individual electrode 19 to a distance of 150 nm are defined as second regions R2. The regions lying below a depth of 150 nm from the surfaces 17*e* and 19*e* of the common electrode 17 and the individual electrode 19 are defined as first regions R1.

Next, a thermal printer Z1 will be described with reference to FIG. 4.

Figure 4:
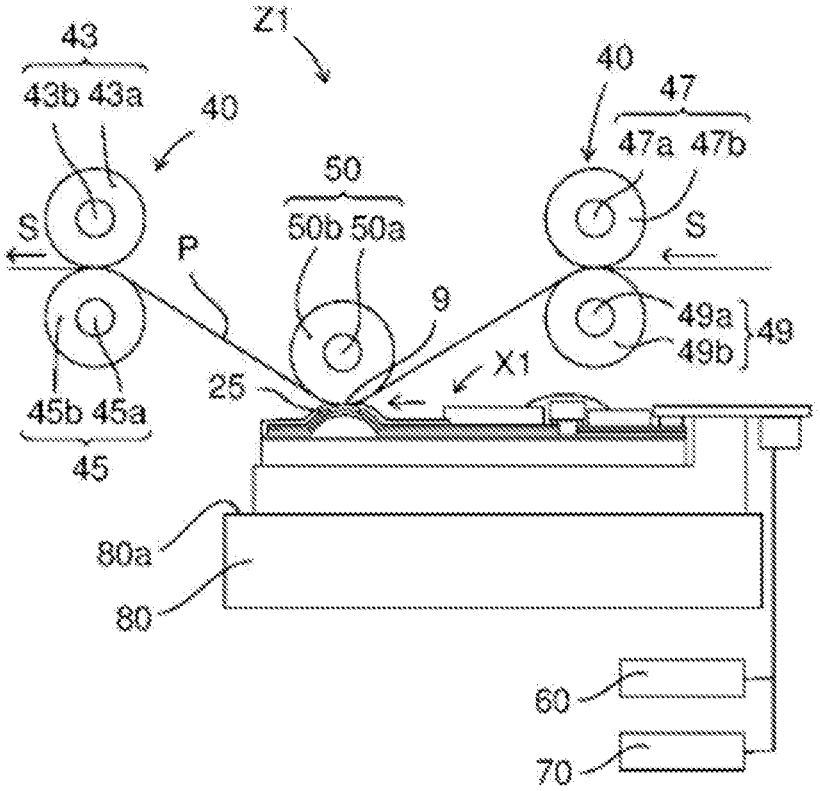
FIG. 4 is a schematic diagram showing a structure of a thermal printer according to the first embodiment of the present invention.

As shown in FIG. 4, the thermal printer Z1 according to this embodiment includes the thermal head X1 described above, a conveying mechanism 40, a platen roller 50, a power-supply unit 60, and a control unit 70. The thermal head X1 is mounted on a mounting surface 80*a* of a mounting member 80 provided in a case (not shown) of the thermal printer Z1. The thermal head X1 is mounted on the mounting member 80 such that the direction in which the heat-generating portions 9 are arranged is directed along a main scanning direction that is orthogonal to a conveying direction S of a recording medium P, which will be described later.

The conveying mechanism 40 includes a driving unit (not shown) and conveying rollers 43, 45, 47, and 49. The conveying mechanism 40 is configured to convey a recording medium P, such as heat-sensitive paper or receiver paper onto which ink is transferred, in the direction S shown in FIG. 4 onto the protective layer 25 located on the plurality of heat-generating portions 9 of the thermal head X1. The driving unit has a function of driving the conveying rollers 43, 45, 47, and 49, and for example, a motor can be used. The conveying rollers 43, 45, 47, and 49 can be formed, for example, by coating cylindrical shafts 43*a*, 45*a*, 47*a*, and 49*a* made of a metal such as stainless steel with elastic members 43*b*, 45*b*, 47*b*, and 49*b* made of butadiene rubber or the like. Although not shown, in the case where the recording medium P is receiving paper or the like onto which ink is transferred, an ink film is conveyed together with the recording medium P between the recording medium P and the heat-generating portions 9 of the thermal head X1.

The platen roller 50 has a function of pressing the recording medium P against the protective layer 25 located on the heat-generating portions 9 of the thermal head X1. The platen roller 50 is placed so as to extend along a direction orthogonal to the conveying direction S of the recording medium P. Both ends of the platen roller 50 are supported so that the platen roller 50 can rotate in a state where the recording medium P is pressed against the heat-generating portions 9. The platen roller 50 can be formed, for example, by coating a cylindrical shaft 50*a* made of a metal such as stainless steel with an elastic member 50*b* made of butadiene rubber or the like.

The power-supply unit 60 has a function of supplying electric current for causing the heat-generating portions 9 of the thermal head X1 to generate heat and electric current for operating the driver ICs 11. The control unit 70 has a function of supplying control signals, which control the operation of the driver ICs 11, to the driver ICs 11 so as to cause the heat-generating portions 9 of the thermal head X1 to generate heat selectively as described above.

As shown in FIG. 4, the thermal printer Z1 performs a predetermined printing operation on the recording medium P by causing the heat-generating portions 9 to generate heat selectively using the power-supply unit 60 and the control unit 70 while pressing the recording medium P against the heat-generating portions 9 of the thermal head X1 using the platen roller 50 and conveying the recording medium P onto the heat-generating portions 9 using the conveying mechanism 40. In the case where the recording medium P is receiver paper or the like, printing on the recording medium P is performed by thermally transferring ink of an ink film (not shown) conveyed with the recording medium P to the recording medium P.

Second Embodiment

Figure 5:
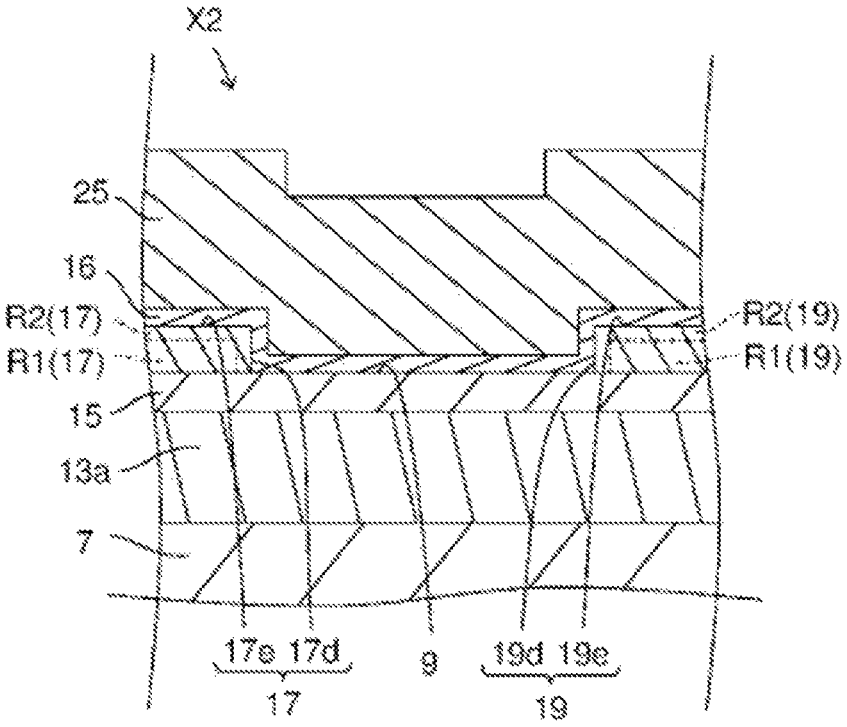
FIG. 5 is an enlarged cross-sectional view of a thermal head according to a second embodiment of the present invention, corresponding to FIG. 3.

A thermal head X2 will be described below with reference to FIG. 5. The thermal head X2 includes a buffer layer 16 which is disposed so as to cover the common electrode 17, the individual electrode 19, and the electrical resistance layer 15. Other than this, the structure is the same of that of the thermal head X1, and the description thereof will be omitted.

The buffer layer 16 can be made of the same material as that of the protective layer 25, and has a function of relaxing stress generated when a recording medium (not shown) is pressed against the protective layer 25. The buffer layer 16 can be made of SiN, SiON, SiC, or SiCN, and from the standpoint of coefficient of thermal expansion, the buffer layer 16 is preferably made of SiN. The thickness of the buffer layer 16 is preferably 0.1 to 0.4 μm from the standpoint of coefficient of thermal expansion.

In the thermal head X2, the buffer layer 16 is provided between the protective layer 25 and the common electrode 17, the individual electrode 19, and the electrical resistance layer 15. Therefore, the buffer layer 16 can relax stress generated between the protective layer 25 and each of the common electrode 17, the individual electrode 19, and the electrical resistance layer 15. Consequently, it is possible to reduce the possibility of separation of the protective layer 25.

Furthermore, in the thermal head X2, the second region R2 is disposed so as to be in contact with the buffer layer 16. Accordingly, the second region R2 having a higher hardness than the first region R1 is sandwiched between the first region R1 and the buffer layer 16. Therefore, it is possible to reduce the amount of stress generated in the second region R2, and it is possible to reduce the possibility that each of the common electrode 17 and the individual electrode 19 will be separated from the protective layer 25.

Furthermore, it is possible to increase the junction area between the second region R2 having a high maximum height (Ry) and the buffer layer 16, and it is possible to improve adhesion between each of the common electrode 17 and the individual electrode 19 and the buffer layer 16.

Third Embodiment

Figure 6:
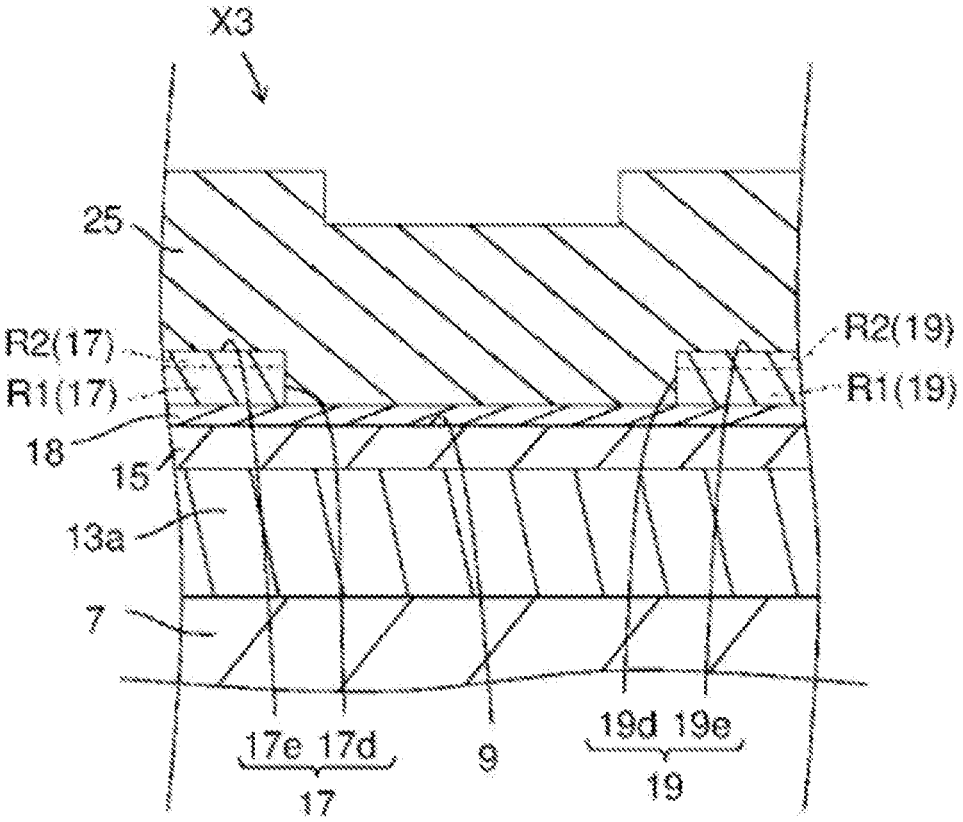
FIG. 6 is an enlarged cross-sectional view of a thermal head according to a third embodiment of the present invention, corresponding to FIG. 3.

A thermal head X3 will be described below with reference to FIG. 6. The thermal head X3 is different from the thermal head X1 in that an oxidation prevention layer 18 is disposed on the electrical resistance layer 15. Furthermore, the thermal head X3 is different from the thermal head X1 in that second regions R2 are not formed over the entire side surfaces 17*d* and 19*d*. Other than this, the structure is the same as that of the thermal head X1.

In the thermal head X3, the oxidation prevention layer 18 is disposed over the entire area of the electrical resistance layer 15. That is, the oxidation prevention layer 18 patterned in the same shape as that of the electrical resistance layer 15 is disposed on the upper surface of the patterned electrical resistance layer 15.

The oxidation prevention layer 18 has a function of reducing diffusion of oxygen contained in the common electrode 17, the individual electrode 19, and the protective layer 25 into the electrical resistance layer 15. The oxidation prevention layer 18 can be made of SiN, SiON, SiC, or SiCN, and is preferably made of SiO from the standpoint of coefficient of thermal expansion and workability of the wiring pattern.

The thickness of the oxidation prevention layer 18 is preferably 0.05 to 0.2 μm from the standpoint of the coefficient of thermal expansion of the oxidation prevention layer 18, workability of the wiring pattern, and the oxygen diffusion prevention function. The oxidation prevention layer 18 can be formed by sputtering after the electrical resistance layer 15 has been formed.

In the thermal head X3, since the oxidation prevention layer 18 is disposed so as to cover the electrical resistance layer 15, it is possible to reduce the possibility that oxygen contained in the common electrode 17 and the individual electrode 19 will diffuse into the electrical resistance layer 15. Accordingly, it is possible to reduce the possibility that part of the material constituting the electrical resistance layer 15 will become oxidized.

In the common electrode 17 and the individual electrode 19, the second regions R2 are not formed over the entire side surfaces 17*d* and 19*d*. In other words, the second regions R2 are formed only in regions extending to a distance of 150 nm from the upper surfaces 17*e* and 19*e*. In the thermal head X3, the surfaces located on the protective layer 25 side of the common electrode 17 and the individual electrode 19 correspond to the upper surfaces 17*e* and 19*e*.

Therefore, since the second regions R2 are not in contact with the oxidation prevention layer 18, the oxidation prevention layer 18 is unlikely to be oxidized. Consequently, it is possible to improve the long-term reliability of the thermal head X3.

The common electrode 17 and the individual electrode 19 of the thermal head X3 can be formed, for example, by the method described below.

First, a material layer for forming the common electrode 17 and the individual electrode 19 is formed by sputtering over the entire area of the electrical resistance layer 15. At this time, the concentration of oxygen gas to be mixed into argon gas is varied. For example, first regions R1 are formed in a state in which oxygen gas is mixed such that the partial pressure is 2% relative to argon gas, and second regions R2 are formed by gradually increasing the introduction amount of oxygen gas such that the partial pressure of oxygen gas is 15% relative to argon gas. Then, by forming a pattern using a photolithographic technique, the common electrode and the individual electrode 19 can be formed.

Furthermore, it may be configured such that, without providing an oxidation prevention layer 18, second regions R2 are formed only in regions extending to a distance of 150 nm from the upper surfaces 17*e* and 19*e*. In such a case, the second regions R2 are not in contact with the electrical resistance layer 15, and it is possible to reduce the possibility that the electrical resistance layer 15 becomes oxidized because of diffusion of oxygen contained in the second regions R2.

Fourth Embodiment

Figure 7:
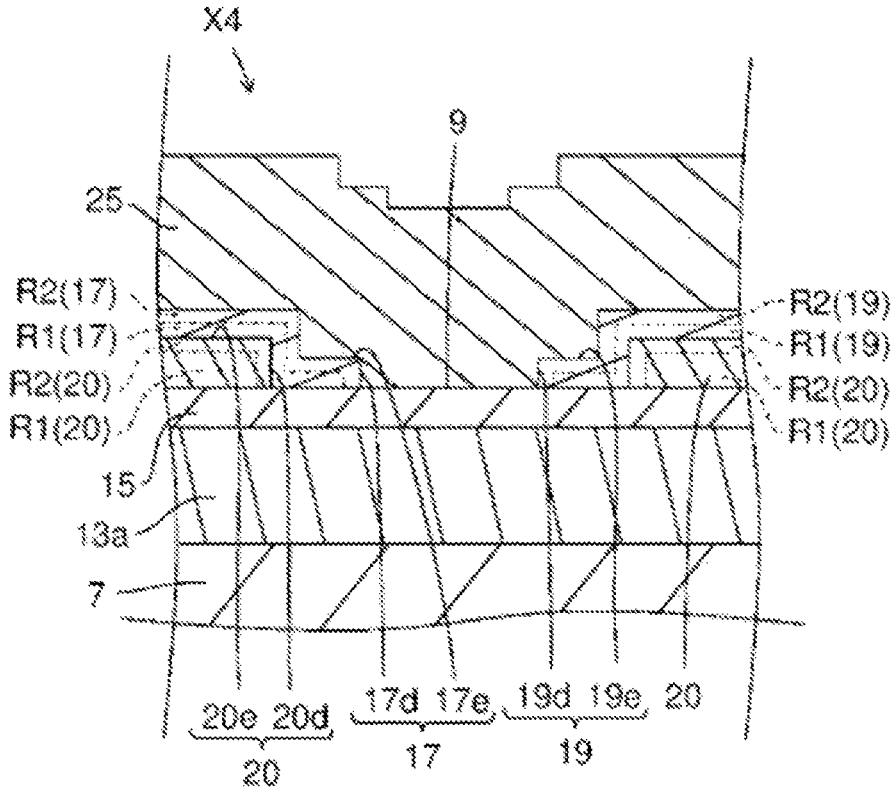
FIG. 7 is an enlarged cross-sectional view of a thermal head according to a fourth embodiment of the present invention, corresponding to FIG. 3.

A thermal head X4 will be described below with reference to FIG. 7. The thermal head X4 is different from the thermal head X1 in that each electrode includes a thick electrode portion 20. Other than this, the structure is the same as that of the thermal head X1.

In the thermal head X4, the electrode has a two-portion structure including a thick electrode portion 20 and a thin electrode portion (common electrode 17 or individual electrode 19). The thick electrode portion 20 is formed by a thick-film forming technique such as printing. The thick electrode portion 20 is disposed at a predetermined distance from the heat-generating portion 9, and the electrode and the heat-generating portion 9 are electrically connected to each other by the common electrode 17 or the individual electrode 19 disposed on the thick electrode portion 20.

The thick electrode portion 20 includes a first region R1 and a second region R2. The first region R1 lies below a depth of 150 nm from the surfaces 20*d* and 20*e* located on the protective layer 25 side, and is located closer to the electrical resistance layer 15 side than to the protective layer 25. The second region R2 extends to a distance of 150 nm from the surfaces 20*d* and 20*e* located on the protective layer 25 side, and is located closer to the protective layer 25 side than to the electrical resistance layer 15. The first region R1 is provided below the second region R2.

In the thermal head X4, the second region R2 is provided on the protective layer 25 side of the thick electrode portion 20, in addition to each of the common electrode 17 and the individual electrode 19. Therefore, by reducing heat dissipation from the electrode, thermal efficiency can be further improved. Furthermore, since the electrode incudes two second regions R2: the second region R2 of the common electrode 17 or the individual electrode 19 and the second region R2 of the thick electrode portion 20, corrosion resistance can be further improved.

The electrodes of the thermal head X4 can be formed, for example, by the method described below.

First, thick electrode portions 20 are formed by printing. Then, in order to form a second region R2 on the surface 20*e* and the side surface 20*d* of each of the thick electrode portions 20, heat treatment is performed in an oxygen atmosphere.

Subsequently, a common electrode 17 and an individual electrode 19 are formed by sputtering in a state in which oxygen gas is mixed such that the partial pressure is 2% relative to argon gas. After the common electrode 17 and the individual electrode 19 have been formed, by performing heat treatment in an oxygen atmosphere, second regions R2 are formed.

In the thermal head X4, although the example has been described in which the common electrode 17 and the individual electrode 19 disposed on the thick electrode portions 20 each include a second region R2, the second region R2 may not be provided. In the case where the common electrode 17 and the individual electrode 19 disposed on the thick electrode portions 20 each do not include a second region R2, it is possible to suppress heat dissipation from the common electrode 17 and the individual electrode 19. In such a manner, the second region R2 may be disposed at a distance of 0.05 to 0.2 nm from the surface of each of the common electrode 17 and the individual electrode 19.

Although the embodiments of the present invention have been described, it should be understood that the present invention is not limited to the embodiments described above, and that various changes and alterations can be made without departing from the spirit and scope of the present invention. For example, the thermal printer Z1 using the thermal head X1 according to the first embodiment has been described. The thermal printer Z1 is not limited thereto, but the thermal heads X1 to X4 may be used for the thermal printer Z1. Furthermore, the thermal heads X1 to X4 according to the embodiments may be combined together.

In the thermal head X3, the example has been described in which, in the process of forming the second region R2, the introduction amount of oxygen gas is gradually increased such that the partial pressure of oxygen gas relative to argon gas increases. However, the process is not limited thereto. For example, the second region R2 may be formed by, after forming the common electrode 17 and the individual electrode 19 by sputtering, performing heat treatment in which heat is applied for a predetermined time in a mixed gas atmosphere of argon gas and oxygen gas. Furthermore, the second region R2 may be formed by gradually increasing the heat treatment temperature.

Furthermore, in the thermal head X1, the heat storage layer 13 includes the elevated portion 13*b*, and the electrical resistance layer 15 is disposed on the elevated portion 13*b*. However, the structure is not limited thereto. For example, without providing the elevated portion 13*b* in the heat storage layer 13, the heat-generating portions 9 of the electrical resistance layer 15 may be disposed on the base 13*b* of the heat storage layer 13. Alternatively, without forming the heat storage layer 13, the electrical resistance layer 15 may be disposed on the substrate 7.

Furthermore, in the thermal head X1, the common electrode 17 and the individual electrodes 19 are disposed on the electrical resistance layer 15. However, the structure is not limited thereto as long as the common electrode 17 and the individual electrodes 19 are connected to the heat-generating portions 9 (electric resistors). For example, the common electrode 17 and the individual electrodes 19 may be disposed on the heat storage layer 13, and the electrical resistance layer 15 may be formed only in regions between the common electrode 17 and the individual electrodes 19 to constitute the heat-generating portions 9.

Furthermore, the thermal head X1 has been described using a thin-film head in which the electrical resistance layer 15 is formed by a thin-film forming technique. However, the thermal head X1 may be a thick-film head in which the electrical resistance layer 15 is formed by a printing technique which is a thick-film forming technique. Furthermore, the example has been described in which the heat-generating portions 9 are provided on the principal surface of the substrate 7. However, the heat-generating portions 9 may by provided on the end face of the substrate 7.

REFERENCE SIGNS LIST

X1 to X4 thermal head
Z1 thermal printer
1 heat sink
3 head base body
5 flexible printed wiring board
7 substrate
9 heat-generating portion (electric resistor)
11 driver IC
13 heat storage layer
15 electrical resistance layer
17 common electrode
19 individual electrode
21 connection electrode
23 joint material
24 oxidation prevention layer
25 protective layer
27 covering layer
29 covering member

What is claimed is:

1. A thermal head comprising:
a substrate;
a heat-generating portion disposed on the substrate;
an electrode disposed on the substrate and electrically connected to the heat-generating portion; and
a protective layer which covers the heat-generating portion and the electrode,
wherein the electrode includes a first region which lies below a depth of 150 nm from a surface located on the protective layer, and the first region contains 1 to 13 atomic percent of oxygen.

2. The thermal head according to claim 1, wherein the electrode includes a second region which extends to a distance of 150 nm from the surface located on the protective layer, and the second region contains oxygen.

3. The thermal head according to claim 2, wherein the oxygen content in the second region is higher than the oxygen content in the first region.

4. The thermal head according to claim 2, wherein the second region of the electrode contains 1 to 50 atomic percent of oxygen.

5. The Thermal head according to claim 2, wherein the oxygen content of a part of the second region in the vicinity of the protective layer is larger than that of a part of the second region in the vicinity of the first region.

6. A thermal printer comprising:
the thermal head according to claim 1;
a conveying mechanism that conveys a recording medium onto the heat-generating portion; and a platen roller that presses the recording medium against the heat-generating portion.

7. The thermal head according to claim 1, wherein a maximum height of the electrode is 0.095 to 0.2 μm.

8. A thermal head comprising:

a substrate;

a heat-generating portion disposed on the substrate;

an electrode disposed on the substrate and electrically connected to the heat-generating portion; and a protective layer which covers the heat-generating portion and the electrode, wherein the electrode includes a first region which is under the protective layer and a second region which is sandwiched between the first region and the protective layer, wherein the first region and the second region contain oxygen, and wherein a oxygen content of the second region is larger than that of the first region.

9. The thermal head according to claim 8, wherein the second region of the electrode contains 1 to 50 atomic percent of oxygen.

10. The thermal head according to claim 8, wherein a maximum height of the electrode is 0.095 to 0.2 μm.

11. The Thermal head according to claim 8, wherein the oxygen content of a part of the second region in the vicinity of the protective layer is larger than that of a part of the second region in the vicinity of the first region.

12. A thermal printer comprising:

the thermal head according to claim 8;

a conveying mechanism that conveys a recording medium onto the heat-generating portion; and a platen roller that presses the recording medium against the heat-generating portion.

13. A thermal head comprising:

a substrate;

a heat-generating portion disposed on the substrate;

an electrode disposed on the substrate and electrically connected to the heat-generating portion; and a protective layer which covers the heat-generating portion and the electrode, wherein the electrode includes a first region which is under the protective layer and a second region which is sandwiched between the first region and the protective layer, and wherein a coefficient of thermal expansion of the second region is smaller than that of the first region.

14. The thermal head according to claim 13, wherein the first region and the second region contain oxygen.

15. The thermal head according to claim 13, wherein the first region of the electrode contains 1 to 13 atomic percent of oxygen.

16. The thermal head according to claim 13, wherein the second region of the electrode contains 1 to 50 atomic percent of oxygen.

17. The thermal head according to claim 13, wherein the oxygen content of a part of the second region in the vicinity of the protective layer is larger than that of a part of the second region in the vicinity of the first region.

18. A thermal printer comprising:

the thermal head according to claim 13;

a conveying mechanism that conveys a recording medium onto the heat-generating portion; and a platen roller that presses the recording medium against the heat-generating portion.

19. A thermal head comprising:

a substrate;

a heat-generating portion disposed on the substrate;

an electrode disposed on the substrate and electrically connected to the heat-generating portion; and a protective layer which covers the heat-generating portion and the electrode, wherein the electrode includes a first region which lies below a depth of 150 nm from a surface located on the protective layer, and the first region contains oxygen, and wherein a maximum height of the electrode is 0.095 to 0.2 μm.

20. A thermal printer comprising:

the thermal head according to claim 19;

a conveying mechanism that conveys a recording medium onto the heat-generating portion; and a platen roller that presses the recording medium against the heat-generating portion.

* * * * *